US006027369A

United States Patent [19]

Conorich et al.

[11] Patent Number: 6,027,369

[45] Date of Patent: Feb. 22, 2000

[54] HINGEABLE WIRING BLOCK

[75] Inventors: Theordore Alan Conorich, Parsippany; Wayne Scott Filus, Lebanon, both of N.J.

[73] Assignee: Lucent Technologies Inc., Murray Hill, N.J.

[21] Appl. No.: 09/169,529

[22] Filed: Oct. 9, 1998

[51] Int. Cl.[7] ..... H01R 13/60

[52] U.S. Cl. ..... 439/532; 439/573

[58] Field of Search ..... 439/532, 564, 439/573, 713

[56] References Cited

U.S. PATENT DOCUMENTS 5,083,941 1/1992 Rodgers et al. ..... 439/532 OR
5,312,270 5/1994 Siemon et al. ..... 439/532 OR
5,352,136 10/1994 Chen ..... 439/532 OR
5,575,674 11/1996 Davis et al. ..... 439/573 X

*Primary Examiner*—Paula Bradley
*Assistant Examiner*—Daniel Wittels
*Attorney, Agent, or Firm*—Darby & Darby

[57] ABSTRACT

A hingeable leg subassembly for a wiring block of the type having a wiring base includes a wiring base support and a foot spaced away from the wiring base support along the leg. The foot has a lower surface and a generally opposite upper surface which defines an aperture therethrough. The aperture has an entrance at the upper surface, having a first size which is less than a second size at an exit on the lower surface. A wiring block is formed with two of the hingeable leg subassemblies, with a wiring base affixed to the hingeable leg subassemblies and a wiring strip supported by the wiring base is also disclosed.

14 Claims, 6 Drawing Sheets

HINGEABLE WIRING BLOCK

FIELD OF THE INVENTION

The present invention relates generally to wiring blocks and, more particularly, to wiring block arrangements which facilitate wire management during cable routing.

BACKGROUND OF THE INVENTION

Wiring block assemblies are well-known in the art. In particular, there are a variety of conventional wiring block assemblies commonly referred to as a 110-type connectors. The 110-type connector is described in several prior patents including U.S. Pat. Nos. 3,611,264; 3,798,587 and 4,118,095. One version of a typical wiring block comprises a wiring base with legs at each end. The legs provide a space behind the wiring block, once mounted, for accommodating the routing of wires and cables that terminate at the front of the wiring base. Each leg terminates at a respective foot, which is provided with two or more mounting apertures. The upper surface of the wiring base has slots which receive and secure respective wiring strips. For a complete discussion of connector blocks, see the aforementioned U.S. Pat. No. 3,798,587, the entirety of which is incorporated herein by reference as if fully set forth herein.

A problem attendant with conventional 110-type connectors is that the leg subassemblies obstruct access to the cable and wires in the back of the wiring base. Solutions to the access problem have included detachable wiring strips and leg subassemblies. However, such solutions have only partially addressed the problem of access by alleviating initial wire placement difficulties without improving access to the wires for connection to, disconnection from, and servicing at the wiring block.

In order to fully install a wiring block and completely terminate all of the wires, the wires and cables must be guided through their respective pass-through positions in the wiring base so they can be terminated on the front of the wiring block. In conventional designs, this involves holding the wiring block while feeding up to seventy-two 4-pair cables into their designated pass-through slots. These methods are even more difficult when wire is being routed to several wiring blocks at the same time.

Another solution to the access problem employs hinges which allow the wiring base to swing away from the surface to which it is attached. Known wiring blocks use external hinges and external mounting frames to effect hinged movement. For a complete discussion of hinged mounting brackets for use in conjunction with wiring blocks, see U.S. Pat. No. 5,595,507, the entirety of which is incorporated herein by reference as if fully set forth herein. Although effective, the use of external components for the hinge in such prior art constructions increases cost and, to some extent, decreases reliability by virtue of the extra parts.

What is needed in the art, and has heretofore not been known, is a wiring block arrangement which overcomes the problems of prior art designs and further provides improved wire access during installation and service.

SUMMARY OF THE INVENTION

The hingeable wiring block of the present invention addresses these needs. In accordance with one aspect of the present invention, a hingeable wiring block comprises first and second legs each having a foot at one end and a wiring base support at another end. A wiring base is affixed to the legs, for example, at the wiring base support. In conventional manner, the wiring base supports a wiring strip. As a departure from the prior art, the foot of each leg has at least one aperture extending therethrough, with the aperture defining an entrance having a first size and an exit having a second size which is larger than the first size. This structural arrangement permits the wiring block to be loosely attached to a support structure by way of a fastener inserted through one or more apertures on one foot, yet permits the wiring block to be tipped about the fastener(s) by moving the foot relative to the fastener(s). Travel of the wiring block relative to the fastener(s) is restricted by the size of the exit of the aperture in the foot, and it is confined to a single plane when two screws are loosely fastened to the wiring block. The fulcrum of pivotal movement goes through both screws. The screws thus allow the wiring blocks to rotate outwardly.

In accordance with another aspect of the invention, a leg sub-assembly for a wiring block is disclosed. The leg includes a wiring base support at one end and a foot spaced away from the wiring base. As in the above-described wiring block arrangement, the foot has an upper and lower surface with one or more apertures extending therethrough, the apertures defining an entrance of a first size and an exit of a second size which is greater than the first size.

In use, one leg of a wiring block is loosely fastened to a support surface with, for example, two fasteners. Once the fasteners have loosely fastened the leg to the support surface, the leg is pivoted about the fasteners to expose the space behind the wiring block, thereby increasing access to such space—all without providing a separate hinge. Once all of the wires or cables have been placed in their appropriate pass-through holes in the wiring base, the hinge fasteners as well as additional fasteners on the opposite side of the wiring block (that is, on the other leg) are tightly secured to the support to hold the wiring block steady. Then the wires can be terminated on the front surface.

The above-discussed features and advantages of the present invention will be readily appreciated and understood by those skilled in the art from the following detailed description and drawings of a preferred embodiment of the present invention.

BRIEF DESCRIPTION OF THE DRAWINGS

Referring now to the unscaled drawings wherein like elements are numbered alike in the several FIGURES.

DETAILED DESCRIPTION OF THE PREFERRED EMBODIMENT

Figure 1:
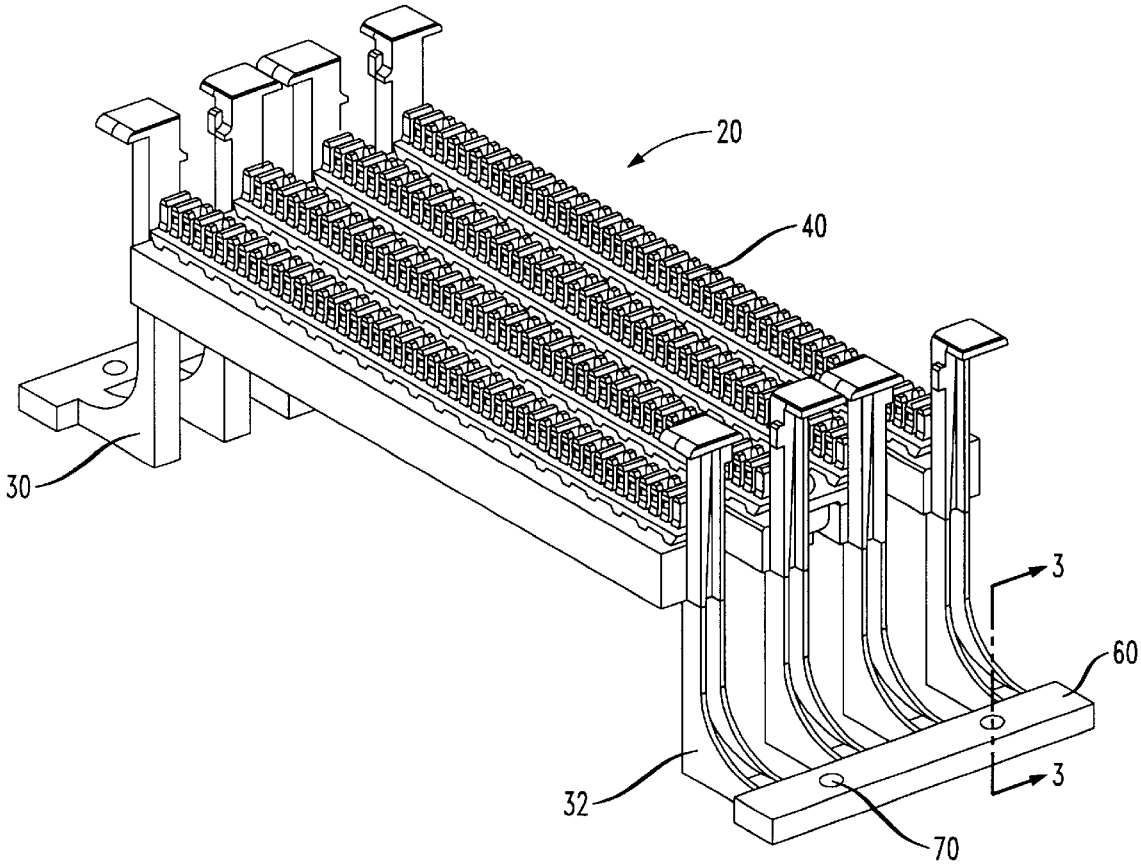
FIG. 1 is a perspective view of a hingeable wiring block according to the present invention.

FIG. 1 is a perspective view of a wiring block assembly 20 which includes legs 30, 32 and a wiring base 40. The wiring base 40 forms no part of the present invention, and may be of a conventional design, for example, a series 110 wiring base commercially available from Lucent Technologies, Murray Hill, N.J. The wiring block assembly 20 is attachable to a support surface 50 (see FIG. 2), typically located within a service closet or other out-of-the-way location. The wiring base may be configured to terminate a bare or insulated wire, cable, optical fiber or conventional connector.

Figure 2:
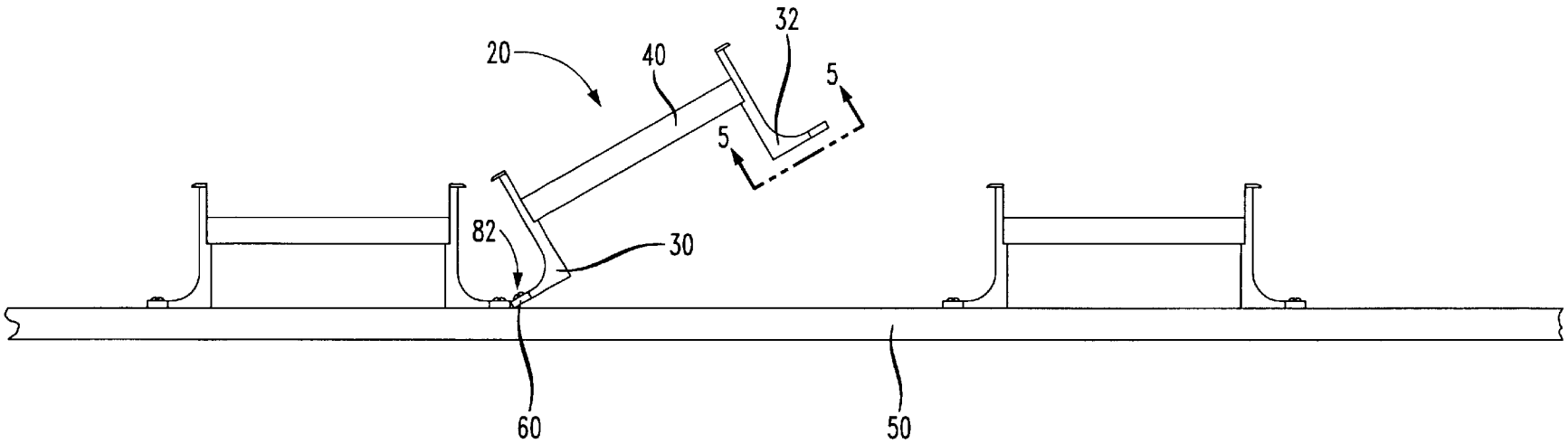
FIG. 2 shows several hingeable wiring blocks attached to a support surface, with the center block rotated outward.

In accordance with the invention, either the legs 30 or 32 of the wiring block assembly 20 can hinge relative to the support surface 50 if screw fasteners attaching the legs to the base are incompletely seated on one leg and no fasteners have been used to restrict movement of the other leg. Such hingeable movement provides access to the under-surface of the wiring base 40, as shown in FIG. 2. A series of wiring blocks may be mounted end-to-end in a horizontal row, as shown in FIG. 2, from top-to-bottom in a vertical stack (i.e., to extend in a plane in and out of the plane of FIG. 2), or both horizontally and vertically in a grid.

Figure 3:
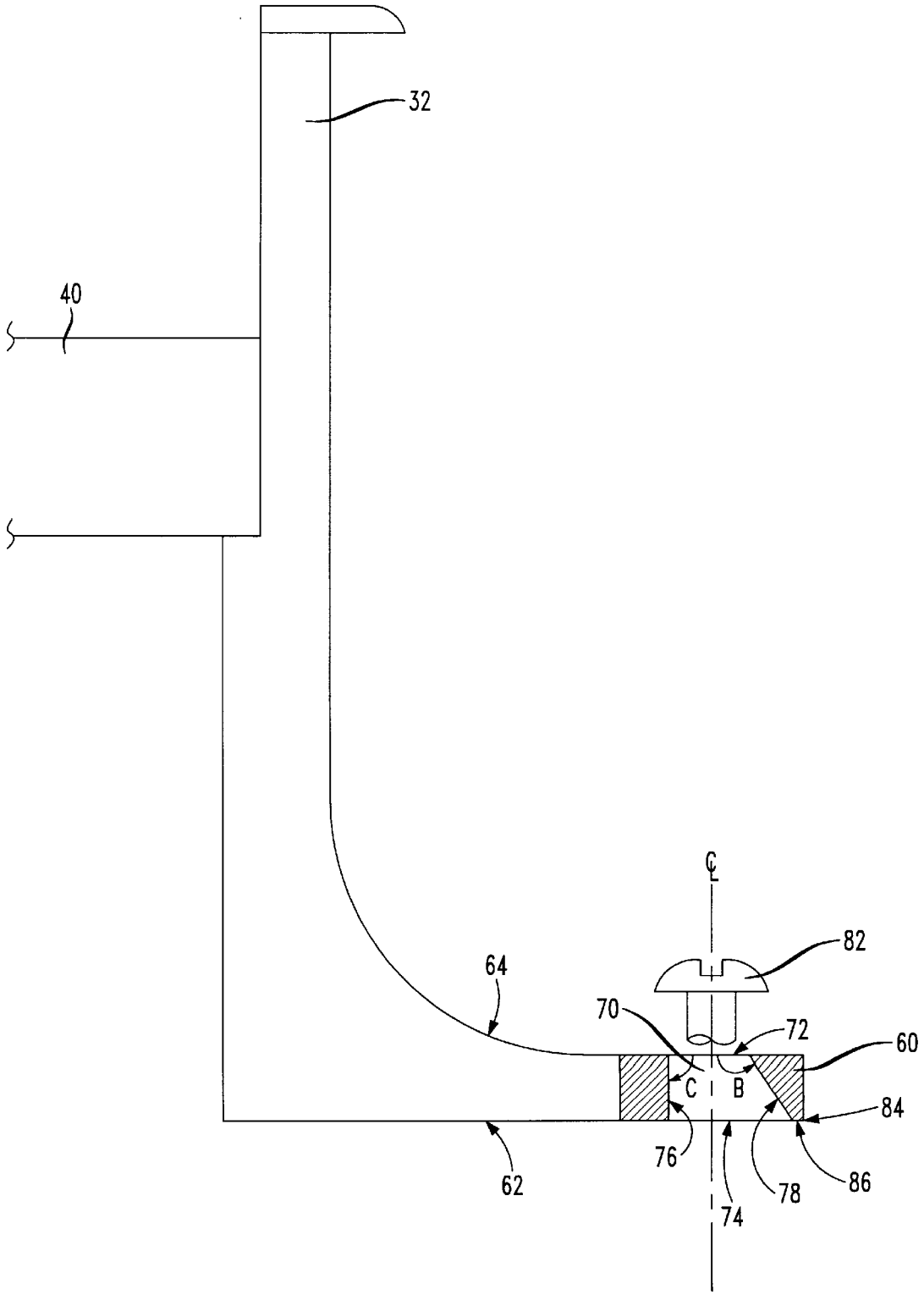
FIG. 3 is a side detail view, partially in section, of an embodiment of a leg of the wiring block taken along line 3—3 of FIG. 1.

With reference now to FIG. 3, each leg 30, 32 has a foot 60 which is spaced away from the wiring base 40. The foot 60 has two primary surfaces, a lower surface 62 which contacts a support surface 50 and an upper surface 64 generally opposite the lower surface 62. In addition, each foot 60 is shown having at least two apertures 70 extending from the lower surface 62 to the upper surface 64 (FIG. 1).

Figure 4:
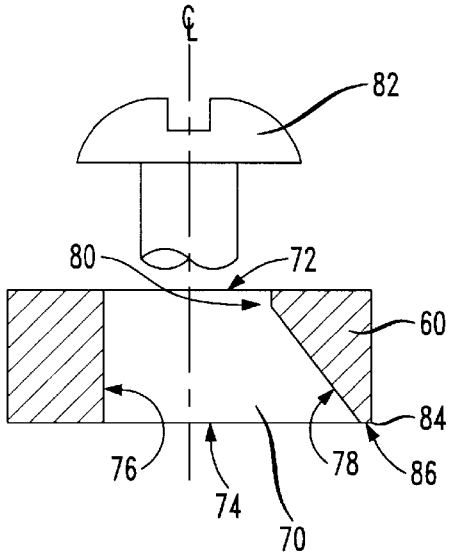
FIG. 4 is a side detail view of the end of the foot of FIG. 3, partially in section, showing a modification in accordance with a preferred aspect of the present invention.

With further reference to FIGS. 3 and 4, the aperture 70 has a non-uniform cross-section between the upper surface 64 and the lower surface 62. The upper surface 64 defines an entrance 72 (having a first size) which is smaller than an exit 74 (having a second size) located at the lower surface 62 (see FIG. 5). Preferably, the aperture 70 has a polygonal cross-section (see FIG. 4) in a direction which extends through the foot 60 between the upper and lower surfaces 64, 62, and a dromic cross-section in a plane which is generally parallel to the upper and lower surfaces. Other cross-sectional shapes extending through the foot which allow pivotal movement of the foot 60 (see FIGS. 6 and 7) can be provided within the spirit of my invention. The entrance 72 preferably has a circular shape and the exit 74 preferably has a dromic shape, that is, parallel sides joined by generally hemispherical and convex boundaries, as shown in FIG. 5, to permit pivotal movement of the leg 30, 32 about screw 82 which is located within the aperture 70; however, other shapes can be used with equal advantage.

Figure 6:
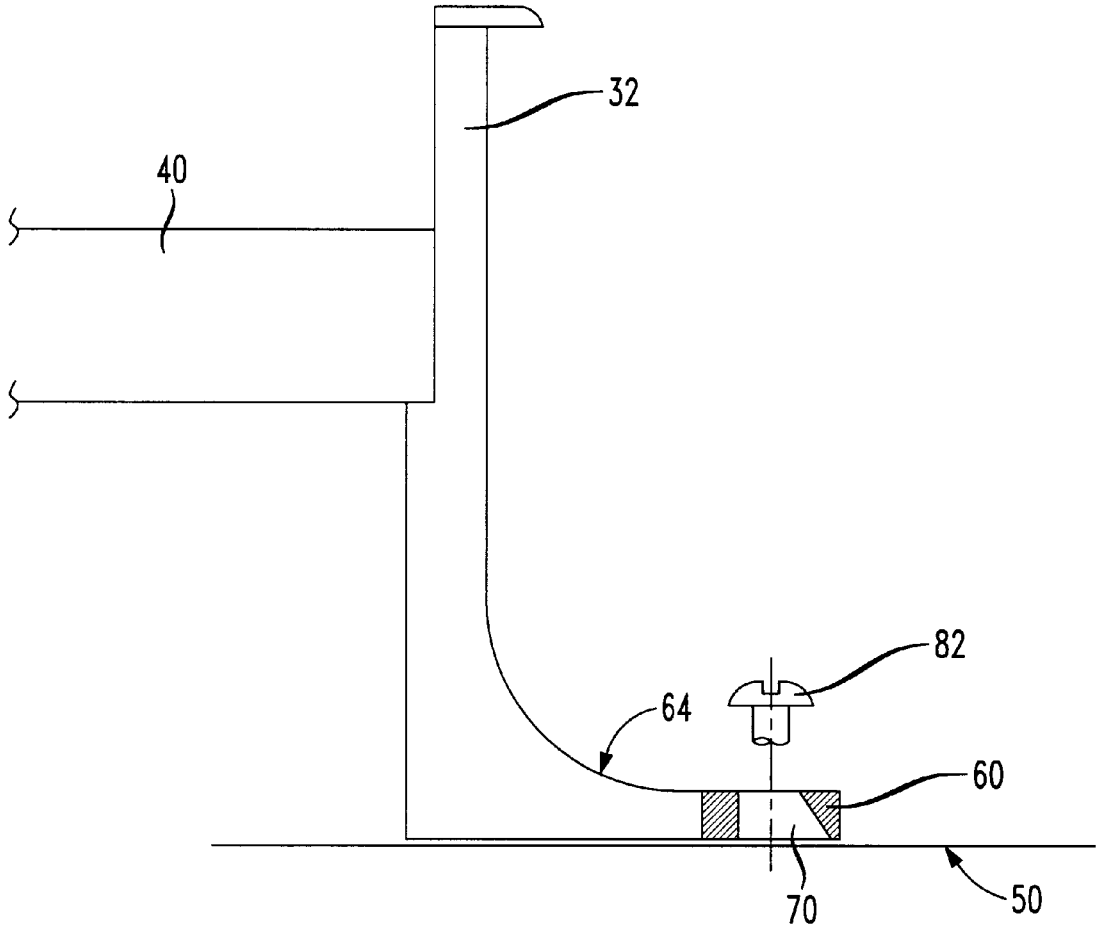
FIG. 6 is a side elevation view of the leg of FIG. 3, loosely fastened to a support structure, shown flush with the surface.
Figure 7:
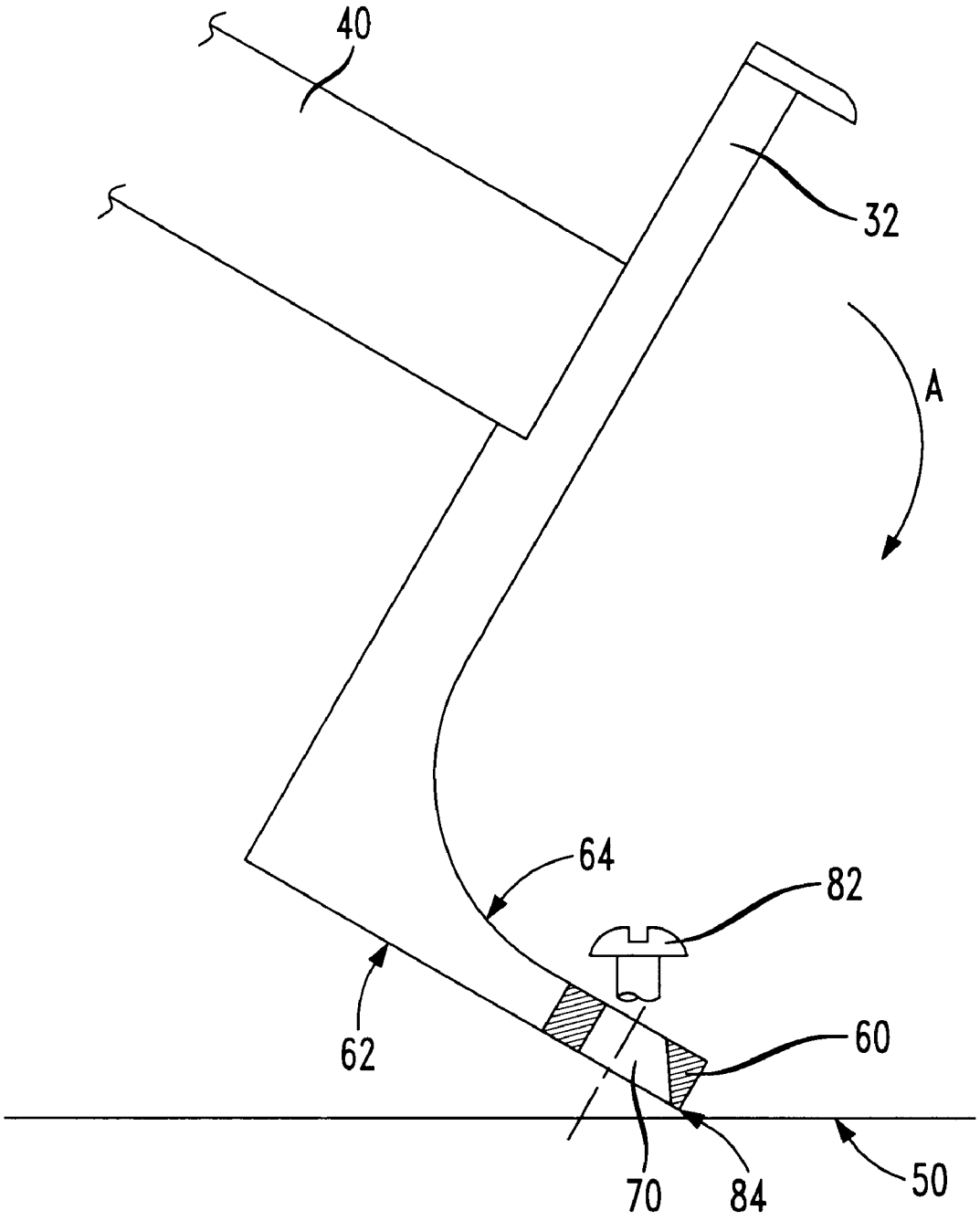
FIG. 7 is a side elevation view of the leg of FIG. 3, loosely fastened to a support structure, shown hinged from the surface.

Preferably, as shown in FIG. 3, a first side wall 76 of the aperture 70 is generally at a 90 degree angle C to the upper surface 64 to define one extreme position in which the wiring block assembly 20 is positioned flush against the support surface 50 (see FIG. 6). A second side wall 78 (FIG. 3)is preferably arranged at an angle B to the upper surface 64, preferably at an angle greater than 90 and less than about 125 degrees from the upper surface 64, in order to permit hinged movement of one wiring block assembly 20 in the direction of arrow A to the position shown in FIG. 7 without interfering with an adjacent wiring block (see FIG. 2). This provides a technician with sufficient access to the underside of the wiring base 40.

With reference again to FIG. 4, an optional shoulder 80 is provided along the second side wall 78 and oriented generally parallel to the first side wall 76 to provide an abutment which reduces stress in the plastic once a screw 82 has been fully tightened into the support surface 50. Shoulder 80 assists in dissipating hoop stress in the foot 60 as the fastener 82 is tightened, and is an optional yet preferred feature. As will be appreciated from FIG. 4, a proportional relationship exists between the diameter of the entrance 72 and the diameter of the fastener. Even when a shoulder 80 is provided, a screw diameter of between 0.138" (#6 screw) and 0.164" (#8 screw) can be used to loosely fasten and permit wiring block rotation if the entrance 72 is about 0.200", for example.

Figure 5:
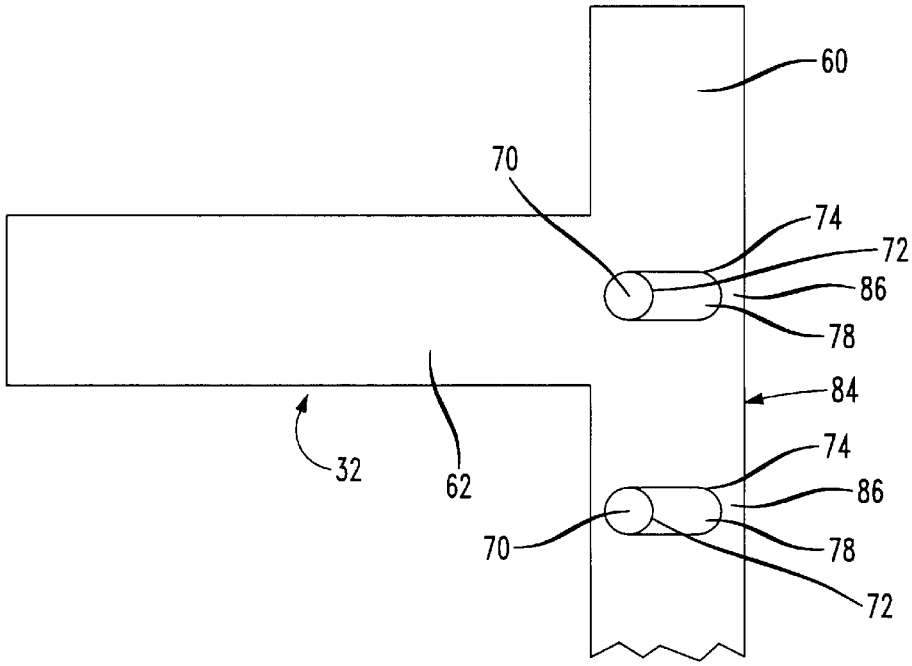
FIG. 5 is a bottom view of a foot on a leg of a wiring block, taken in the direction of line 5—5 of FIG. 2.

Optionally, a pad 86 may be provided along the lower surface 62 adjacent the toe 84 and sidewall 78 of exit 74 (see FIGS. 3, 4 and 5). The pad 86 reduces the stress caused by an attempt to rotate the block past its free travel range. The pad 86 should not be large, since it affects how far the fastener must protrude from the foot to achieve a full range of pivotal movement, and since a large pad 86 would require a greater space between adjacent wiring blocks.

In use, the wiring block assembly 20 is hinged by loosely fastening one of legs 30, 32 relative to the support surface 50. For example, the screw 82 is placed through the aperture 70 and is partially threaded into engagement with a support surface 50. Standard screws have a head which will engage the upper surface 64 of the foot 60, once the screw 82 is in place, and secure the wiring block to the support surface 50. Once one of the legs 30, 32 has been loosely fastened to the support surface 50 with, for example, two screws, the wiring block assembly 20 can be pivoted about the screw 82. One extreme position of the leg subassembly 30, 32 is reached (i) when the head of the screw 82 engages the upper surface 64 or (ii) when the upper portion of the screw shaft engages the intersection of surface 76 and surface 64 or (iii) when a threaded portion of the screw 82 contacts one or more points on the sidewall 78 of the aperture 70. About 30° of such hinging of the wiring block assembly 20 provides sufficient access to the under surface of the wiring base 40 for servicing the wire block connections. Once all the wires have been placed in their respective pass-through openings of the wiring base 40, the screws 82 are tightened to secure the leg 30, and screws are installed and tightened in opposing leg 32 to secure the lower surface 62 of each foot 60 to the support surface 50. The wires can then be terminated on the front of the wiring base.

While the invention has been particularly shown and described with reference to preferred embodiments thereof, it will be understood by those skilled in the art that variations and modifications in form and details may be made therein without departing from the spirit and scope of the invention. Accordingly, the foregoing disclosure, description, and figures are merely illustrative, and do not in any way limit the invention, which is defined solely by the claims.

What is claimed is:

1. A hingeable leg subassembly for a wiring block of the type having a wiring base, the hingeable leg subassembly comprising:

a wiring base support; and a foot spaced away from said wiring base support along said leg, said foot having an aperture therethrough, said aperture defining an entrance having a first size and an exit having a second size, said first size being less than said second size, said aperture being generally rectangular in a first cross-section and polygonal in a second, orthogonal cross-section, said foot further having an upper surface which defines the aperture entrance and a lower surface which defines the aperture exit, said aperture has a first side wall which is generally orthogonal to said lower surface.

2. The hingeable leg subassembly as in claim 1, wherein said entrance is circular in shape.

3. The hingeable leg subassembly as in claim 1, wherein said exit is dromic in shape.

4. The hingeable leg subassembly as in claim 1, wherein said aperture has a second side wall at an angle greater than 90 and less than about 125 degrees relative to said upper surface.

5. The hingeable leg subassembly as in claim 4, wherein a portion of said second side wall has a shoulder generally orthogonal to said lower surface and extending downwardly relative to said upper surface.

6. The hingeable leg subassembly as in claim 4, wherein said entrance is round and has at least a 0.200 inch diameter.

7. The hingeable leg subassembly as in claim 1, wherein said aperture has a second side wall at an angle of at least 125 degrees relative to said upper surface.

8. A wiring block, comprising:

first and second legs, each of said legs having a foot and a wiring base support;

a wiring base affixed to said first and second legs at their respective wiring base supports; and a wiring strip supported by said wiring base;

wherein each said foot has an upper and lower surface and at least one aperture therethrough, said at least one aperture defining an entrance at the upper surface having a first size and an exit at the lower surface having a second size larger than said first size, said aperture being generally rectangular in a first cross-section and polygonal in a second, orthogonal cross-section, said aperture further having a first side wall which is generally orthogonal to said lower surface.

9. The wiring block as in claim 8, wherein said entrance is circular in shape.

10. The wiring block as in claim 8, wherein said exit is dromic in shape.

11. The wiring block as in claim 8, wherein said aperture has a second side wall at an angle greater than 90 and less than about 125 degrees relative to said upper surface.

12. The wiring block as in claim 11, wherein a portion of said second side wall has a shoulder generally orthogonal to said lower surface and extending downwardly relative to said upper surface.

13. The wiring block as in claim 11, wherein said entrance is round and has at least a 0.200 inch diameter.

14. The wiring block as in claim 8, wherein said aperture has a second side wall at an angle of at least 125 degrees relative to said upper surface.

* * * * *